United States Patent [19]

Mimoun et al.

[11] Patent Number: 4,881,651

[45] Date of Patent: Nov. 21, 1989

[54] ROTATABLE ORGANIZER WITH INTEGRAL PIVOT NUB AND PERIPHERAL REDUCED AREA CONTACT NUBS

[75] Inventors: Nancy Mimoun; Benson Zinbarg, both of Stamford, Conn.

[73] Assignee: Sun Hill Industries, Inc., Stamford, Conn.

[21] Appl. No.: 232,326

[22] Filed: Aug. 12, 1988

[51] Int. Cl.[4] ..... B65D 25/24

[52] U.S. Cl. ..... 220/18; 220/21; 220/22; 211/78

[58] Field of Search ..... 211/78; 220/20, 18, 220/21, 22

[56] References Cited

U.S. PATENT DOCUMENTS

| | | | |
|---|---|---|---|
| 2,511,715 | 6/1950 | Kappel | 211/78 |
| 2,600,922 | 6/1952 | Rodolfa | 211/78 |
| 2,743,030 | 4/1956 | Read, Jr. | 220/21 |
| 3,004,745 | 10/1961 | Wilson | 211/78 |
| 3,855,943 | 12/1974 | Larson | 211/78 |
| 4,225,052 | 9/1980 | Tector et al. | 220/22 |
| 4,432,151 | 2/1984 | Morris | 211/78 |

*Primary Examiner*—A. Michael Chambers

*Attorney, Agent, or Firm*—Frishauf, Holtz, Goodman & Woodward

[57] ABSTRACT

A rotatable organizer includes a container having a circular flat bottom, a circumferential cylindrical side wall secured at the outer periphery of the flat bottom, and a plurality of compartments formed on the flat bottom and within the side wall; a main pivot nub formed centrally on the flat bottom for rotatably supporting and spacing the container from a support surface; and a plurality of spaced apart, off-center support nubs on the flat bottom in surrounding relation to the pivot nub for raising the flat bottom off of the surface during rotation of the container and for reducing the area of contact of the rotatable organizer with the support surface during rotation thereof, the support nubs being positioned on the flat bottom in at least one concentric circle with the main pivot nub at the center of each the concentric circle, so as to reduce the area of contact of the rotatable organizer with the support surface and to provide an air cushion between the undersurface of the bottom wall and the support surface.

14 Claims, 5 Drawing Sheets

ROTATABLE ORGANIZER WITH INTEGRAL PIVOT NUB AND PERIPHERAL REDUCED AREA CONTACT NUBS

BACKGROUND OF THE INVENTION

This invention relates generally to organizers, and more particularly, is directed to a rotatable organizer that can be rotatably supported on a flat surface.

Generally, organizers, such as women's make-up organizers, cabinet organizers, desk organizers and the like, are intended to remain stationary on a counter-top, in a cabinet, on a desk or other flat surface, or the like. This is disadvantageous when having to remove an object at the back of the organizer, particularly when the organizer is in a cabinet or closet, or when it is located in an area where the rear portion thereof is difficult to see and/or reach.

The use of "lazy susan" type organizers is known. However, such organizers are relatively complex since they require the use of bearings to rotatably support the organizer and for reducing frictional resistance during rotation of the organizer.

OBJECTS OF THE INVENTION

It is an object of the present invention to provide a rotatable organizer that overcomes the aforementioned problems in the prior art.

It is another object of the present invention to provide a rotatable organizer that is relatively simple and economical to manufacture, easy to use, and which provides for easy rotation.

It is still another object of the present invention to provide a rotatable organizer that has no moving parts, and that provides a means to reduce drag between the undersurface of the rotatable organizer and the support surface during rotation of the rotatable organizer.

The above and other objects, features and advantages of the present invention will become readily apparent from the following detailed description which is to be read in connection with the accompanying drawings.

SUMMARY OF THE INVENTION

In accordance with an aspect of the present invention, a rotatable organizer includes a container having a bottom adapted to rest on a support surface; pivot nub means on the bottom for rotatably supporting the container on the support surface; and a plurality of spaced apart, off-center reduced area contact means on the bottom in surrounding relation to the pivot nub means for raising the bottom off of the support surface during rotation of the container and for reducing the contact area of the rotatable organizer with the support surface during rotation thereof. Preferably, the container has means defining at least one compartment.

In accordance with another aspect of the present invention, a rotatable organizer includes a container having a substantially circular flat bottom, a circumferential cylindrical side wall secured at the outer peripheral portion of the flat bottom, and a plurality of compartments formed on the flat bottom and within the side wall; pivot nub means formed substantially centrally on the flat bottom for rotatably supporting the container on a support surface; and a plurality of spaced apart, off-center reduced area contact means on the flat bottom in surrounding relation to the pivot nub means for raising the flat bottom off of the support surface during rotation of the container and for reducing contact of the rotatable organizer with the support surface during rotation thereof, the reduced contact means protruding from the flat bottom to a lesser degree than the pivot nub means and being positioned on the flat bottom in at least one concentric circle with the pivot nub means substantially at the center of each concentric circle.

DETAILED DESCRIPTION

Figure 1:
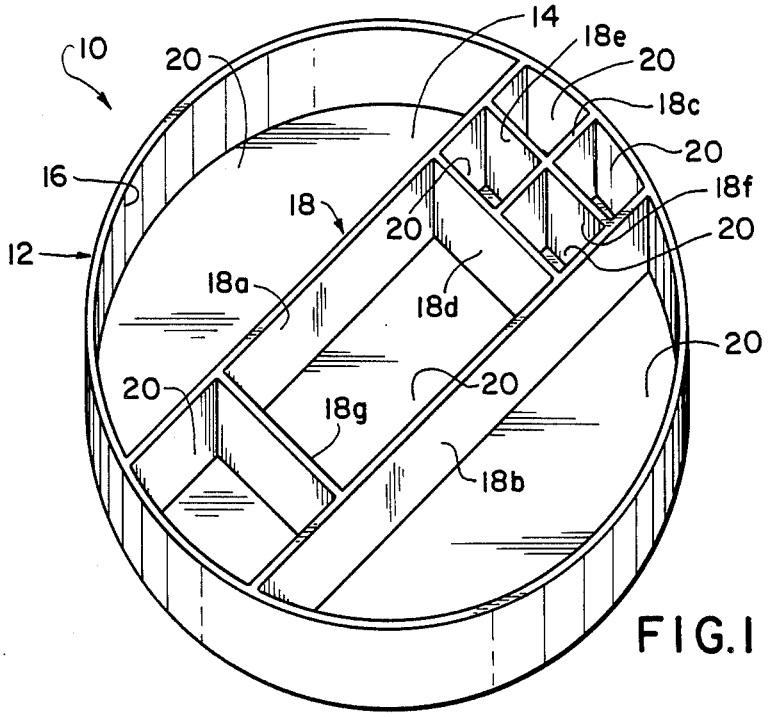
FIG. 1 is a perspective view of a rotatable organizer according to one embodiment of the present invention.
Figure 2:
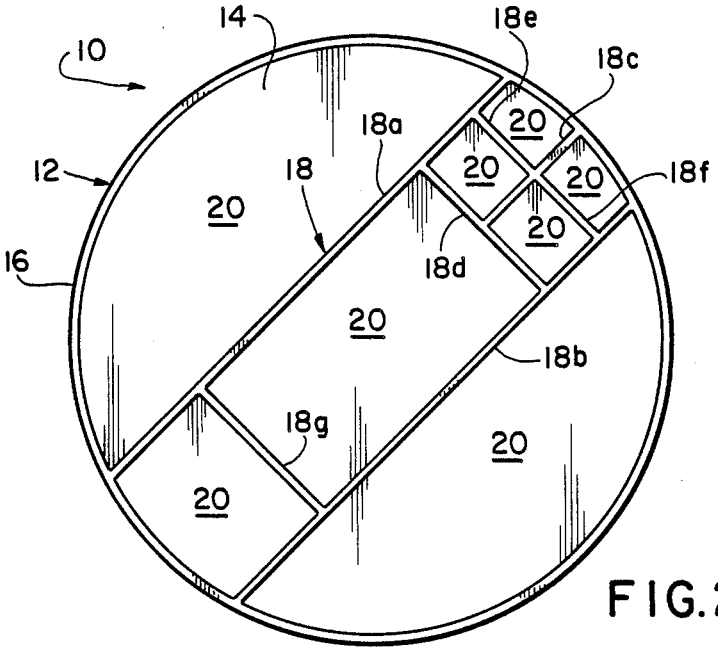
FIG. 2 is a top plan view of the rotatable organizer of FIG. 1.

Referring to the drawings in detail, a rotatable organizer 10 according to the present invention includes a container 12 formed by a substantially flat, substantially circular bottom 14 and a cylindrical side wall 16 extending upwardly from the periphery of bottom 14. As an example, bottom 14 can have a diameter of approximately six inches and side wall 16 can have a height of approximately 1½ inches.

Rotatable organizer 10 is also formed with a plurality of inner walls 18 which divide the interior of container 12 into a plurality of compartments 20 used for storing various items, such as women's cosmetics, lipsticks, nail polish, paper clips, coins, rubber bands, other stationery items, candy, or any other suitable item.

In the embodiment shown, there are two divider walls **18*a* and 18*b* which extend parallel to each other and which are secured at opposite ends to side wall 16. A short divider wall 18*c* is formed centrally between and parallel to divider walls 18*a* and 18*b* and extends a short distance from side wall 16. In addition, a first transverse divider wall 18*d* is secured at the free end of short divider wall 18*c* and transverse thereto, and has its opposite ends secured to parallel divider walls 18*a* and 18*b*. At a point midway along short divider wall 18*c*, two short transverse divider walls 18*e* and 18*f* extend from short divider wall 18*c* to parallel divider walls 18*a* and 18*b*, respectively. Lastly, a transverse divider walls 18*g* extends between parallel divider walls 18*a* and 18*b* at the opposite end of rotatable organizer 10. Of course, all divider walls 18 are preferably connected with bottom 14. Although it has been stated that divider walls 18 are secured to bottom 14, side wall 16 and each other, it will be appreciated that divider walls 18 are preferably formed integrally with bottom 14 and side wall 16 in a one-step molding operation. The container 12** can be molded of any suitable plastics materials. A preferred material is polypropylene, but other plastics such as polystyrene or ABS or others, could be used.

Figure 3:
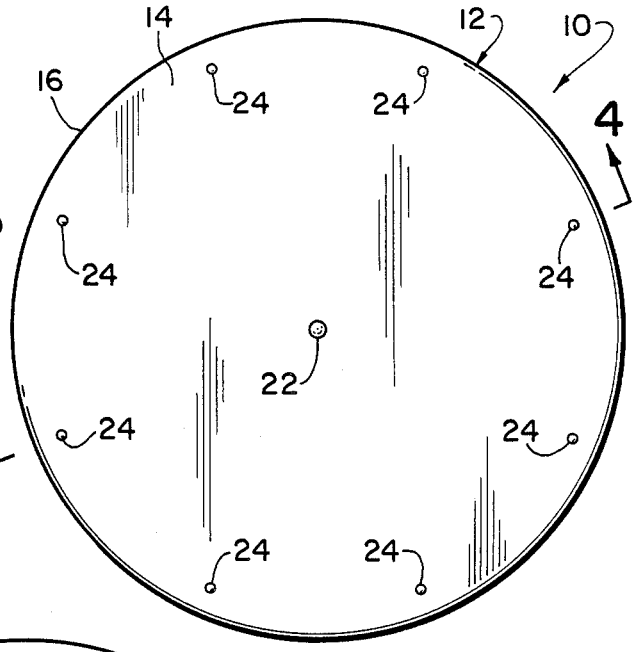
FIG. 3 is a bottom plan view of the rotatable organizer of FIG. 1.
Figure 4:
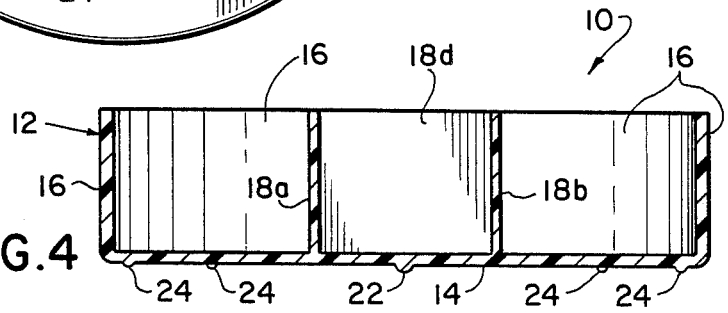
FIG. 4 is a cross-sectional view of the rotatable organizer of FIG. 3, taken along line 4—4 thereof.

In accordance with the present invention, and referring now to FIGS. 3 and 4, rotatably organizer 10 is rotatable so as to present any compartment 20 to the user. Specifically, a main pivot nub 22 is substantially centrally located on the undersurface of bottom 14 and projects downwardly from the undersurface of bottom 14. The rotatable organizer 10 is rotatable about main pivot nub 22, which spaces the bottom 14 from a support surface at least in the vicinity of main pivot nub 22. Thus, when rotatable organizer 10 is spun, it rotates on main pivot nub 22. However, in such case where main pivot nub 22 would be the only protrusion on bottom 14, the undersurface of bottom 14 would provide a substantial drag to rotation, due to frictional contact with the surface on which rotatable organizer 10 is supported.

Accordingly, a plurality of additional support nubs or reduced area contact portions 24 are provided on flat bottom 14 in surrounding relation to main pivot nub 22 for raising flat bottom 14 off of the surface which is supporting rotatable organizer 10, during rotation of container 12. Additional support nubs 24 project downwardly from bottom 14 to a lesser degree than main pivot nub 22 (i.e., additional support nubs 24 are shorter than man pivot nub 22). In such case, additional support nubs 24 provide a number of reduced area contact portions or points for flat bottom 14 so as to reduce frictional drag forces during rotation of rotatable organizer 10. In addition, because of the support nubs 24, flat bottom 14 is effectively raised off of the surface on which rotatable organizer 10 is supported, thereby creating an air cushion between such surface and the undersurface of bottom 14, so as to further reduce drag forces during rotation of rotatable organizer 10. As mentioned above, the height of additional support nubs 24 is less than that of the central main pivot nub 22, as best shown in FIG. 4, to insure that pivoting takes place about central pivot nub 22 and that support nubs 24 provide a minimum of drag force during rotation of rotatable organizer 10.

Main pivot nub 22 and support nubs 24 are preferably formed integrally with bottom 14 during a molding operation. Further, in order to reduce the contact area of rotatable organizer 10 with the surface on which it is supported, nubs 22 and 24 are preferably formed in a hemispherical configuration, to effectively obtain a substantially point contact with the support surface, and thereby further reduce any frictional drag. A substantially hemispherical configuration also presents a smooth bearing surface so as not to damge the surface on which the organizer 10 is mounted. However, any other suitable configuration or shape of nubs 22 and 24 can be provided. Preferably, the main pivot nub 22 and each of the reduced area contact means (additional support nubs) 24 comprise small projections on the bottom 14. Each of the small projections is substantially smaller in area than the overall area of the bottom 14. Thus, the total contact area of the main pivot nub 22 and the reduced area contact means 24 is substantially smaller than the area of the bottom 14 facing the support surface.

Figure 5:
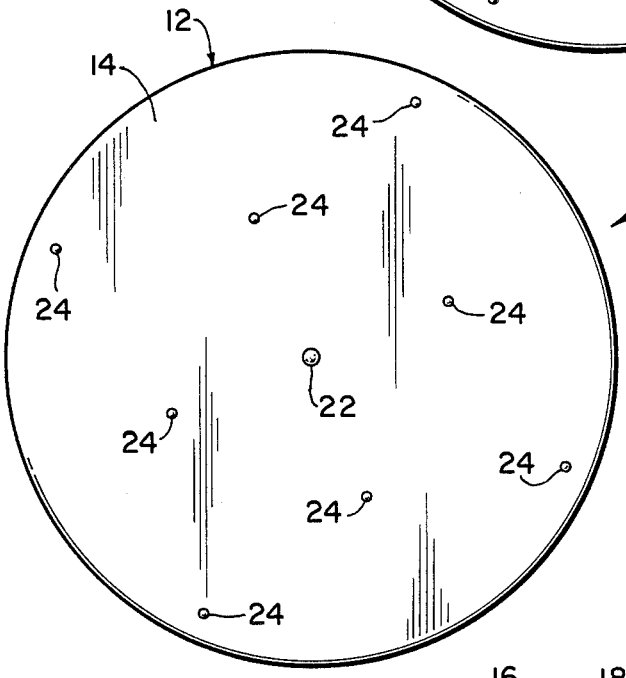
FIG. 5 is a bottom plan view of a rotatable organizer according to another embodiment of the present invention.

With the embodiment of FIGS. 3 and 4, support nubs 24 are formed on bottom 14 along a circle just inside the periphery of bottom 14 and in surround relation to main pivot nub 22, with main pivot nub 22 forming the center of such circle. However, it will be appreciated that any other suitable arrangement of support nubs 24 can be provided. For example, support nubs 24 can be formed in two concentric circles about main pivot nub 22, as shown in FIG. 5. Alternatively, support nubs 24 can be formed in a random manner about main pivot nub 22. The key is that the support nubs 24 provide reduced contact areas for bottom 14 during rotation of rotatable organizer 10 and provide a space to create an air cushion during such rotation.

Various modifications can be made to the present invention within the scope of the claims. Thus, for example, container 12 need not have a circular configuration, but can have any other suitable configuration, such as square, hexagonal, or any other polygonal configuration, and can even have an asymmetric configuration. The only requirement is that rotatable organizer 10 be able to rotate on main pivot nub 22, and that there are a plurality of lower support nubs 24 in surrounding relation thereto to aid in the rotation of rotatable organizer 10 by creating an air cushion and by reducing the area of contact of rotatable organizer 10 with a support surface. Further, although container 12 has been described with divider walls **18*a*–18*g*, any suitable arrangement of divider walls 18 can be provided, depending upon the requirements of the compartments 20**.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

We claim:

1. A rotatable organizer comprising:

a container having a bottom adapted to rest on a support surface;

main pivot nub means fixed to said bottom and consisting of a non-rotatable element projecting downwardly from said bottom for rotatably supporting said container on said support surface such that said container is spaced from said support surface at least in the vicinity of said main pivot means; and a plurality of spaced apart, off-center reduced area contact means fixed to said bottom and consisting of a plurality of non-rotatable elements projecting downwardly from said bottom, and arranged in surrounding relation to said main pivot nub means, for raising said bottom off of said support surface during rotation of said container and for reducing the area of contact of the rotatable organizer with said support surface during rotation thereof.

2. A rotatable organizer according to claim 1, wherein said main pivot nub means projects downwardly from said bottom by a greater amount than said reduced area contact means.

3. A rotatable organizer according to claim 1, wherein said bottom is substantially flat and has a substantially circular configuration and said main pivot nub means is formed substantially centrally of said circle defined by said bottom.

4. A rotatable organizer according to claim 3, wherein said plurality of reduced area contact means are formed on said substantially flat bottom along a circle about said main pivot nub means.

5. A rotatable organizer according to claim 3, wherein said plurality of reduced area contact means are formed randomly on said substantially flat bottom about said main pivot nub means.

6. A rotatable organizer according to claim 1, wherein said main pivot nub means and said reduced area contact means are formed integrally with said bottom in a molding operation.

7. A rotatable organizer according to claim 1, wherein said main pivot nubs means and said reduced area contact means each have a substantially hemispherical configuration.

8. A rotatable organizer according to claim 1, wherein said container includes a side wall extending upwarding from said bottom, and a plurality of compartments formed on said bottom and within said side wall.

9. A rotatable organizer according to claim 8, wherein said bottom is substantially flat and has a substantially circular configuration, and said side wall has a substantially cylindrical configuration and is secured to said substantially flat bottom.

10. A rotatable organizer according to claim 8, further including at least one divider wall secured to at least one of said bottom and said side wall for forming said at least one compartment.

11. A rotatable organizer according to claim 1, wherein said main pivot nub means and each of said reduced area contact means comprise small projections on said bottom, each of which is substantially smaller in area than said bottom, and wherein the total contact area of said main pivot nub means and said reduced area contact means is substantially smaller than the area of said bottom facing said support surface.

12. A rotatable organizer according to claim 11, wherein said main pivot nub means is longer and has a larger cross-sectional area than each of said reduced area contact means.

13. A rotatable organizer comprising:

a container including a substantially circular, substantially flat bottom, a circumferential cylindrical side wall secured at the outer periphery of said substantially flat bottom, and a plurality of compartments formed on said substantially flat bottom and within said side wall;

main pivot rub means fixed to and located substantially centrally on said substantially flat bottom and consisting of a non-rotatable element projecting downwardly from said substantially flat bottom for rotatably supporting said container on a support surface such that the container is spaced from the support surface at least in the vicintiy of said main pivot means; and a plurality of spaced apart, off-center reduced area contact means fixed to said substantially flat bottom and consisting of a plurality of non-rotatable elements projecting downwardly from said substantially flat bottom, and arranged in surrounding relation to said main pivot nub means, for raising said substantially flat bottom off of said support surface during rotation of said container and for reducing the area of contact of the rotatable organizer with said support surface during rotation thereof, said reduced area contact means being positioned on said substantially flat bottom substantially in at least one concentric circle with said main pivot nub means substantially at the center of each said concentric circle.

14. A rotatable organizer according to claim 13, wherein said main pivot nub means projects downwardly from said bottom by a greater amount than each of said reduced area contact means.

* * * * *